United States Patent [19]

Grossbard

[11] 4,020,649

[45] May 3, 1977

[54] BRILLIANTIZED STEP CUT DIAMOND

[76] Inventor: Henry Grossbard, 552 Beach 132nd St., Belle Harbor, N.Y. 11694

[22] Filed: May 27, 1976

[21] Appl. No.: 690,401

[52] U.S. Cl. ..... 63/32

[51] Int. Cl.[2] ..... A44C 17/00

[58] Field of Search ..... 63/32; 125/30; D11/90

[56] References Cited

UNITED STATES PATENTS

| | | | |
|---|---|---|---|
| 138,314 | 4/1873 | Bruhl | 63/32 |
| 2,265,316 | 12/1941 | Schenck | 63/32 |
| 3,796,065 | 3/1974 | Watermeyer | 63/32 |

FOREIGN PATENTS OR APPLICATIONS

| | | | |
|---|---|---|---|
| 40,851 | 1/1937 | Netherlands | 63/32 |
| 6,270 | 2/1893 | Switzerland | 63/32 |

*Primary Examiner*—F. Barry Shay

*Attorney, Agent, or Firm*—Hane, Sullivan & Spiecens

[57] ABSTRACT

A step cut stone with a straight edged polygonal shaped girdle has a generally pyramidal base and a crown with at least girdle and table breaks wherein at least one of these breaks is cut with triangular shaped facets.

8 Claims, 9 Drawing Figures

BRILLIANTIZED STEP CUT DIAMOND

BACKGROUND OF THE INVENTION

The invention pertains to cut stones and more particularly to gem stones such as diamonds.

It is known that the brilliant cut maximizes the fire of a diamond. For this reason such a cut is by far the most popular. However, the cut is the most wasteful of diamond raw material.

On the other hand step cut stones such as square cut diamond and emerald cut diamonds while being more conservative of diamond raw material have none of the fire of brilliant cut diamonds. These facts have been known to the diamond trade for a long time and attempts have been made to devise hybrid cuts to capture the advantages of the square and brilliant cut diamonds.

One such hybrid is shown and described in U.S. Pat. No. 3,796,065 for a stone with an emerald cut crown and a modified brilliant cut base. While such a stone has more brilliance than the conventional square or emerald cut stones it does not approach the brilliance of a brilliant cut stone.

SUMMARY OF THE INVENTION

It is accordingly a general object of the invention to provide a diamond which is on the one hand more brilliant than the heretofore known conventional or hybrid square or emerald cut diamonds and on the other hand is less wasteful of raw material than conventional brilliant cut diamonds.

It is another object of the invention to provide a diamond having the elegance of a straight edged stone with the brilliance of a brilliant cut stone.

Briefly, the invention contemplates a step cut diamond having: a straight edged polygonal shaped girdle; a crown having a girdle break, a table break and a table; and a generally pyramidal base having a girdle break, a culet break, and a culet, wherein at least one of the breaks of the crown is cut with triangular shaped facets.

BRIEF DESCRIPTION OF THE DRAWING

Other objects, the features and advantages of the invention will be apparent from the detailed description when read with the accompanying drawing which shows by way of example the presently preferred embodiment of the invention wherein.

DESCRIPTION OF THE PREFERRED EMBODIMENTS

Figure 2:
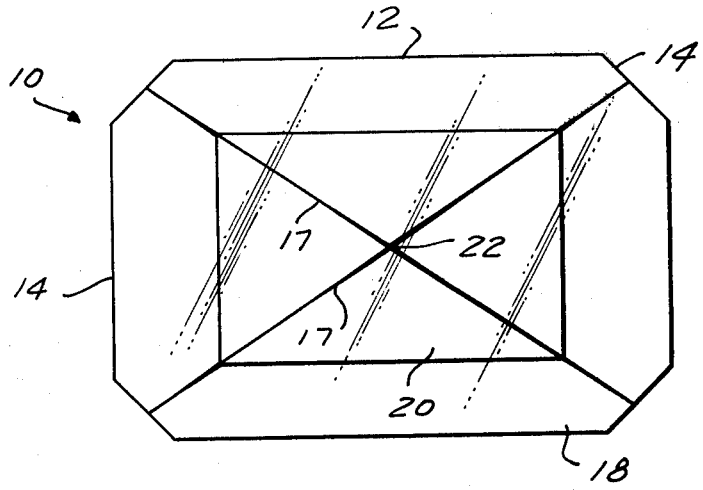
FIGS. 1, 2 and 3 show the side, bottom and top views respectively of a diamond acccording to the invention in an early stage of cutting.
Figure 1:
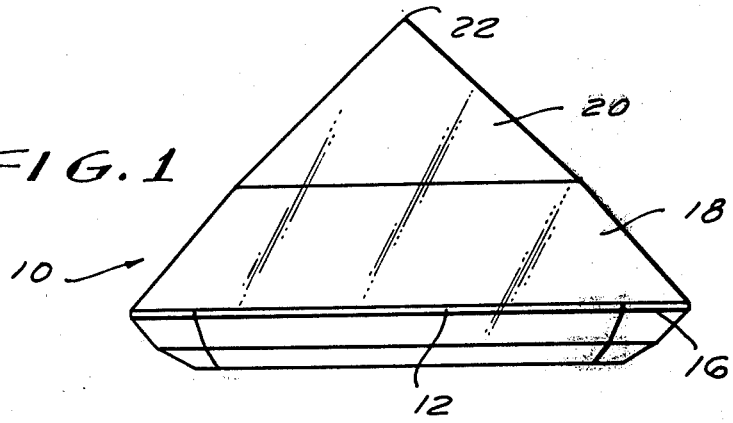
Figure 3:
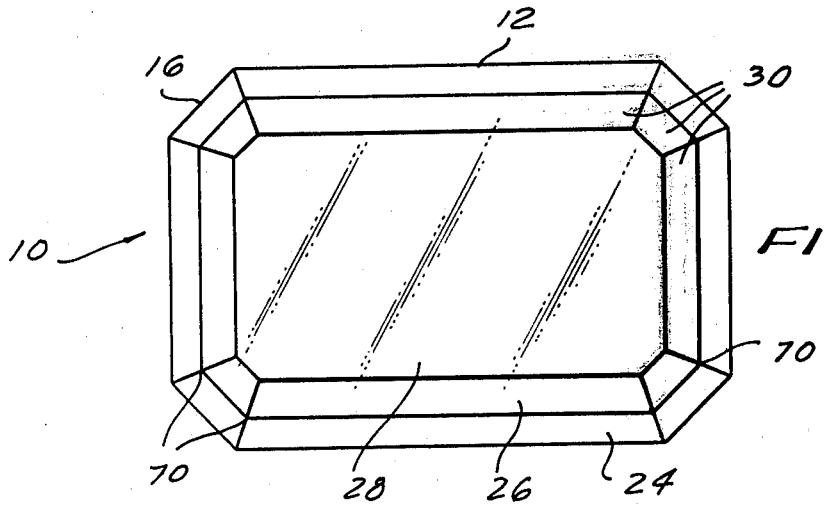

FIGS. 1, 2 and 3 show a step cut diamond 10 having: an octagonal girdle with long side facets 12, short side facets 14 and corner facets 16; a pyramidal base having ridge lines 17, a girdle break 18, a culet break 20 and a culet 22; and a crown having a girdle break 24, a table break 26 and a table 28. The two breaks of the crown should be of approximately equal length. In addition, the angle between the plane of the girdle break of the crown and the table should be in the range from 35° to 42°.

The base of the stone is so cut that the girdle break has from 30 to 40 percent of the base with the culet break the remainder. Thus the angle between the plane of the table and the plane of the girdle break is from 48° to 60°. On the long side the angle between the plane of the culet break and the plane of the table is from 40° to 42°. However, since the culet must be in the direct center of the base the angle between the plane of the culet break on the short side and the plane of the table can be as large as 42° if the original stone is square to as low as 31° if the length to width ratio of the stone is approximately 1.4 to 1.

The diamond 10 as shown and described with respect to FIGS. 1 to 3 is now brilliantized by further cutting of the base and crown.

Figure 4:
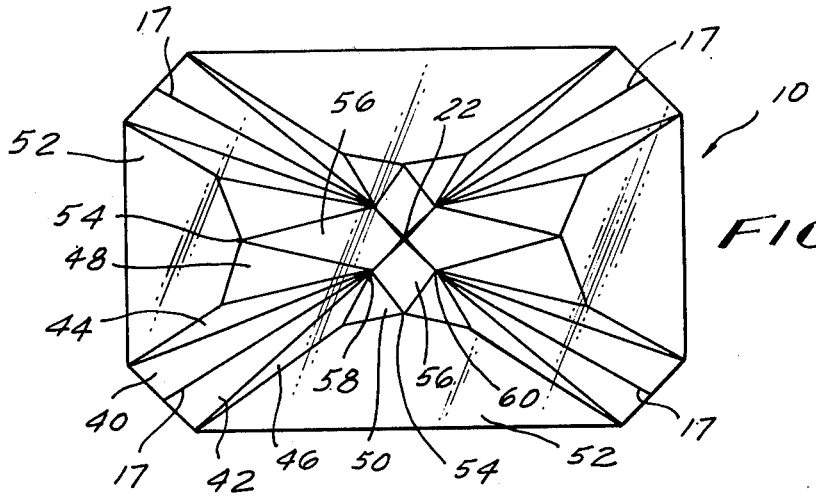
FIG. 4 is a bottom view of the base of a diamond cut in accordance with the invention.
Figure 5:
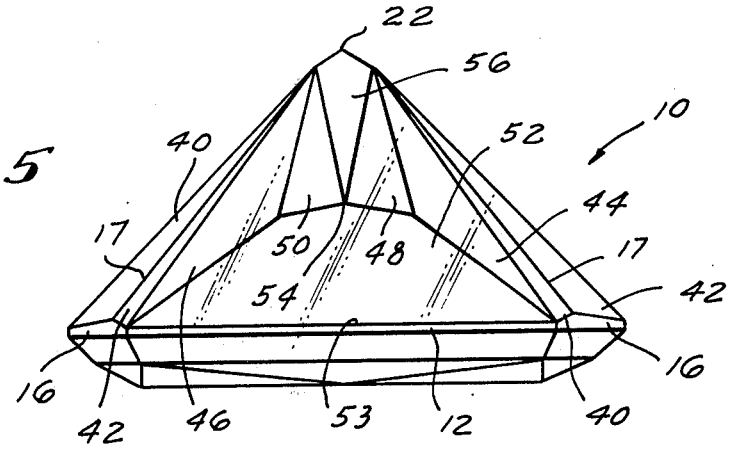
FIG. 5 is a side view of a diamond with a base cut in accordance with the invention and a crown cut in accordance with a first embodiment of the invention.

The base is cut with a fan of from three to seven halves cut symmetrically about each ridge line 17 (FIG. 1). In particular it has been found for enhancing the brilliance to symmetrically place one to three pairs of halves about each of the ridge lines 17. As shown in FIGS. 4 and 5 three pairs of halves are disposed symmetrically about each ridge line, this being the most preferred number of pairs. More specifically, the first pair comprises halves 40 and 42, the second pair comprises halves 44 and 46 and the third pair comprises halves 48 and 50. After the cutting of the fans, there is left in each side of the base girdle break a shield facet 52 with a base 53 colinear with the girdle, and an apex 54. There is also left in each side of the culet break a kite facet 56. Each kite facet has one point in contact with an apex 54, a diagonally opposite point at the culet 22 and a pair of diagonally opposite points 58 and 60 at the radii of different fans. Finally, it should be noted that when looking directly down into the diamond from the table, the apex 54 of each shield facet 50 is not visible or at most just barely protruding into view.

Figure 6:
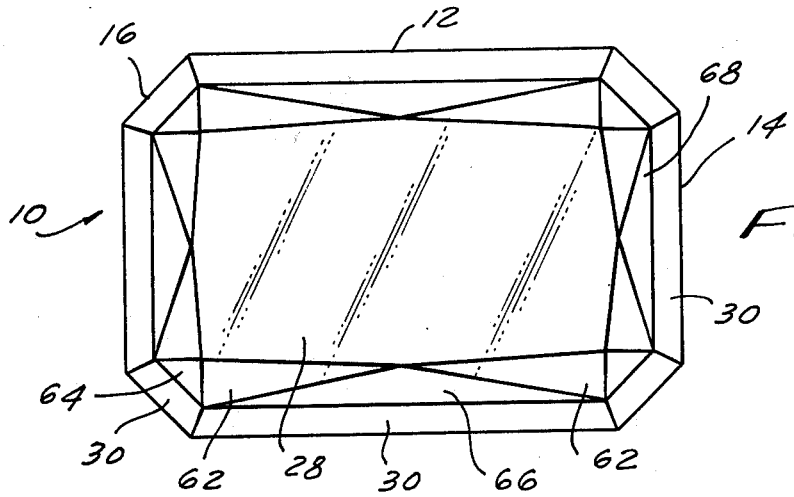
FIG. 6 is a top view of a diamond having a crown cut in accordance with the aforesaid first embodiment of the invention.

The above-described base in accordance with the invention can be used with many crowns. For example, the base can be used with the crown shown and described in FIG. 3. However, to obtain more brilliance one should cut the crown of FIG. 3. A first desirable cut is shown in FIG. 6. There are cut a pair of star facets into each side of the table break 24 of the crown. See FIGS. 5 and 6. Thus the original eight "rectangular" facets 30 of the table break 26 (see FIG. 3) are transformed to sixteen triangular facets of which eight are the star facets 62, four are triangular facets 64 in the corners, two are triangular facets 66 in the long sides and two are triangular facets 68 in the short sides. These triangular facets enhance the brilliance of the diamond 10.

Figure 7:
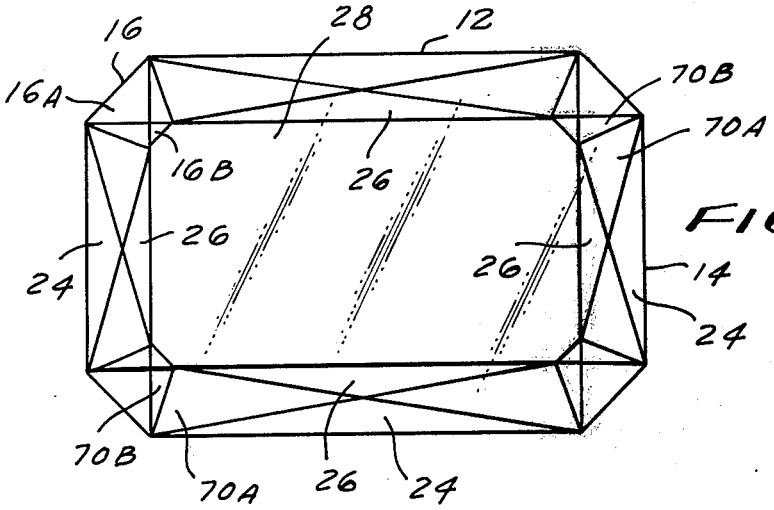
FIG. 7 is a top view of a diamond having a crown cut in accordance with another embodiment of the invention.

An alternate cutting of the crown shown in FIG. 3 has pairs of halves (half facets) cut starting at each of the middle corner points 70. Such alternate cutting of the crown is shown in FIG. 7 wherein the original sixteen "rectangular" facets of the crown are now cut into thirtytwo triangular facets. Four of these triangular facets are the remains of the table break 26; four are the remains of the girdle break 24; four are the remains of the table break in the corner 16B; four are the remains of the girdle break in the corner 16A; and the remaining sixteen are either of the pairs of halves, such as halves 70A and 70B.

Figure 8:
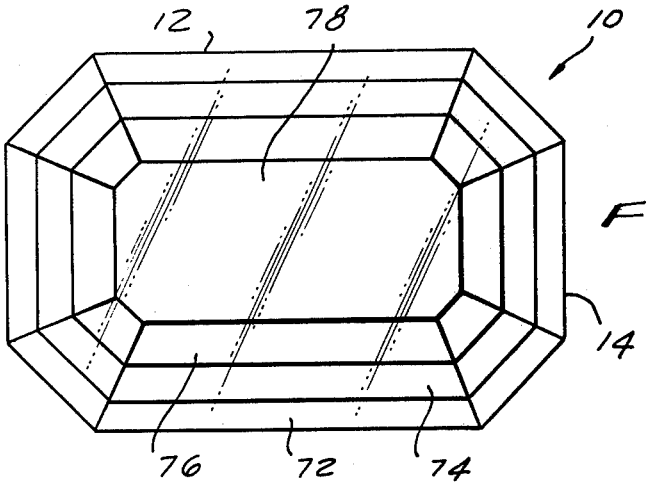
FIG. 8 is a top view of a diamond having a conventional three break emerald cut crown.

Again starting from the crown of FIG. 3 a new crown can be cut having the three conventional breaks of the emerald cut stone by splitting the table and girdle breaks 26, 24. Thus FIG. 8 shows the crown having girdle break 72, middle break 74, table break 76 and table 78. Although this crown can be used with the base described in FIGS. 4 and 5 the brilliance can be enhanced by further cutting this crown.

Figure 9:
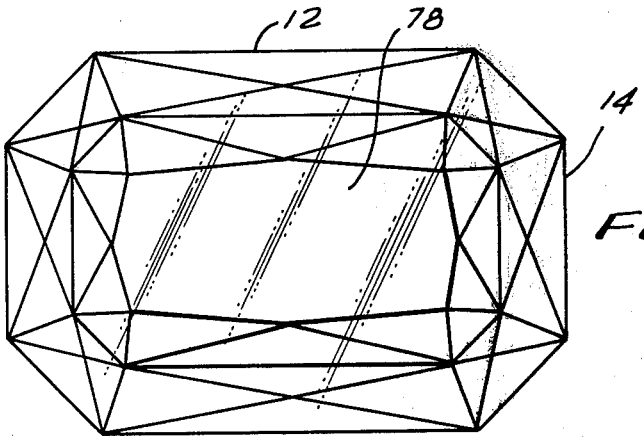
FIG. 9 is a top view of the diamond of FIG. 8 after having its crown cut in accordance with a further embodiment of the invention.

As shown in FIG. 9 the girdle and middle breaks 72, 74 of FIG. 8 are cut with pairs of half facets in the same fashion as the girdle and table breaks 24, 26 of FIG. 3 were cut to form the crown of the diamond of FIG. 7. In addition, the table break 76 of the stone of FIG. 8 is cut with star facets in the same way the table break 26 of the stone of FIG. 3 was cut to form the triangular facets in the stone of FIG. 6. Therefore the crown of the stone of FIG. 9 has fortyeight triangular facets.

There has thus been shown a step cut diamond, which can range from a square cut to rectangular cut and which has a brilliancy approaching the brilliancy of brilliant cut or round diamonds with nowhere near the loss of raw material. In fact, if the "raw material" stone is an original emerald cut stone which is now being recut there is only about a twelve percent loss in the weight. This minor loss is far outweighed by the large increase in brilliance which results from the star faceting of the crown and the fan cutting of the base to provide deep shield facets.

While only a limited number of embodiments of the invention has been shown and described in detail there will now be obvious to those skilled in the art many modifications and variations satisfying many or all of the objects of the invention but which do not depart from the spirit thereof as defined by the appended claims. For example, although there has been shown only a rectangular cut stone, the invention contemplates any straight edged polygon stone such as regular or irregular hexagonal stones, truncated kite shaped stones, pentagons, etc.

What is claimed is:

1. A brilliantized step cut diamond comprising: a straight edged polygonal shaped girdle with a plurality of side facets and corner facets; a crown, said crown having a girdle break, a table break and a table, said table break being cut with triangular shaped facets and said girdle break being cut with guadrilaterally shaped facets; and a pryamidal base, said pyramidal base having a girdle break, a culet break, a point culet and a plurality of ridges, each of said ridges extending from said culet toward a corner, a fan of at least three pairs of triangular halves symmetrically disposed about each ridge of said pyramidal base, a kite shaped facet on each side of the base on the culet break and disposed between each fan, and a shield shaped facet on each side of the base on the girdle break, each shield shaped facet having a base line parallel to the girdle and an apex in contact with a point of the associated kite shaped facet.

2. The brilliantized step cut diamond of claim 1 wherein said girdle is substantially rectangular and has four side facets and four corner facets, said table is substantially rectangular, and each of said fans comprises three pairs of halves to provide a gradual turn around each of said ridges.

3. The brilliantized step cut diamond of claim 2 wherein said girdle and said table have oblong substantially rectangular shapes with two wide sides and two narrow sides.

4. The brilliantized step cut diamond of claim 3 wherein said kite shaped facets make an angle of between 31° and 42° with the girdle plane.

5. The brilliantized step cut diamond of claim 3 wherein the kite shaped facets on the wide sides of base form an angle of between 40° and 42° and the kite shaped facets on the narrow sides of the base form an angle which is less than 40° but greater than 31°.

6. The brilliantized step cut diamond of claim 4 wherein the girdle break of the base occupies from thirty to forty percent of the total depth of the base.

7. The brilliantized step cut diamond of claim 4 wherein the girdle break of the crown makes an angle of from 35° to 45° with the plane of the girdle.

8. The brilliantized step cut diamond of claim 7 wherein the length of the girdle and table breaks of the crown are approximately equal.

* * * * *